US006578846B2

(12) United States Patent
Maul et al.

(10) Patent No.: US 6,578,846 B2
(45) Date of Patent: Jun. 17, 2003

(54) DEVICE FOR TRANSPORTING A SHEET FOR A ROTARY PRINTING MACHINE

(75) Inventors: Albert Maul, Heidelberg (DE); Jürgen Rautert, Heibelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 132 days.

(21) Appl. No.: 09/817,577

(22) Filed: Mar. 26, 2001

(65) Prior Publication Data

US 2002/0135123 A1 Sep. 26, 2002

(30) Foreign Application Priority Data

Mar. 24, 2000 (DE) ..... 100 14 417

(51) Int. Cl.[7] ..... B65H 5/12

(52) U.S. Cl. ..... 271/277; 271/275; 271/276; 271/69; 271/314

(58) Field of Search ..... 271/277, 775, 271/276, 69, 314

(56) References Cited

U.S. PATENT DOCUMENTS

| | | | | |
|---|---|---|---|---|
| 4,122,773 A | | 10/1978 | Wirz | |
| 4,378,734 A | * | 4/1983 | Wirz | 101/230 |
| 5,431,386 A | | 7/1995 | Blaser | |

FOREIGN PATENT DOCUMENTS

| | | |
|---|---|---|
| DE | 627 851 | 3/1936 |
| DE | 24 19 747 C3 | 11/1975 |
| DE | 35 35 621 C2 | 4/1987 |
| DE | 42 18 421 A1 | 12/1993 |
| EP | 0 658 425 A1 | 6/1995 |
| GB | 446462 | 4/1936 |
| JP | 55-18194 | 4/1980 |

* cited by examiner

*Primary Examiner*—Donald P. Walsh
*Assistant Examiner*—Jonathan R Miller
(74) *Attorney, Agent, or Firm*—Laurence A. Greenberg; Werner H. Stemer; Ralph E. Locher

(57) ABSTRACT

A device for transporting a sheet for a sheet-processing machine in a processing direction includes first grippers for gripping the sheet at a leading gripper edge, as viewed in the direction of processing, the first grippers revolving in a first direction during operation. Also provided is a cylinder bearing the first grippers, and having a support surface formed at the circumference thereof for supporting the sheet gripped by the first grippers. Further provided are second grippers for taking over the leading gripper edge of the respective sheet from the first grippers, the second grippers revolving in a second direction opposite to the first direction; and at least one pair of sheet supports rotating about a rotational axis and formed with a pitch surface disposed concentric with the rotational axis, the pitch surface having an extent along the rotational axis less than the width of a respective nonprinted lateral margin of the respective sheet, and serving to press the sheet against the support surface within a respective lateral margin in regions of common normals of the support surface and the pitch surfaces. Additionally provided are suction grippers revolvable in the second direction and for taking over from the cylinder a trailing gripper margin of the sheet which has been placed on the support surface of the cylinder by the sheet supports.

11 Claims, 5 Drawing Sheets

DEVICE FOR TRANSPORTING A SHEET FOR A ROTARY PRINTING MACHINE

BACKGROUND OF THE INVENTION

Field of the Invention

The invention relates to a device for transporting a sheet for a sheet-processing machine, particularly a rotary printing machine, in a processing direction, the transporting device having first grippers for gripping the sheet at a leading gripper edge, as viewed in the direction of processing, the first grippers revolving in a first direction during operation; a cylinder bearing the first grippers, the cylinder having a support surface formed at the circumference thereof for supporting the sheet gripped by the first grippers; second grippers for taking over the leading gripper edge of the respective sheet from the first grippers, the second grippers revolving in a second direction opposite to the first direction; and at least one pair of sheet supports rotating about a rotational axis and formed with a pitch surface disposed concentric with the rotational axis, the pitch surface having an extent along the rotational axis less than the width of a respective nonprinted lateral margin of the respective sheet, and serving to press the sheet against the support surface within a respective lateral margin in regions of common normals of the support surface and the pitch surfaces. The invention also relates to a sheet-fed printing machine, particularly a rotary printing machine, that is equipped with the sheet-transporting device.

A device of the aforedescribed type has been disclosed heretofore by the published Japanese Patent Document JP SHO 55-18194 Y2, in accordance with which it is used to transfer a printed sheet from a printing unit to a delivery, including a continuous conveyor with grippers disposed at revolving gripper bars, by which a leading gripper edge of the sheet is grippable, the sheet, after leaving the impression cylinder, being further conveyable by the trailing edge thereof at its own resources. However, all that is achieved by this method is that the sheet is positively guided at the nonprinted side margins thereof until the trailing edge thereof passes the regions of the common normals of the cylinder surfaces and the support surface of the impression cylinder.

In order to guide the sheet farther along the path thereof to a stacking or pile station without causing smearing, it has become known heretofore, particularly, to provide sheet guide surfaces and to create flow relations between those sheet guide surfaces, on the one hand, and the respective sheet, on the other hand, which has been withdrawn therefrom, that keep the sheet at a given floating height above the sheet guide surfaces.

Alternatively, it has also been proposed heretofore in the prior art that the sheets, after exiting from a printing unit, be guided on a path to a stacking or pile station by leading edge grippers and trailing edge grippers revolving out of phase relative to one another (note the published German Patent Document DE 42 18 421 A1). To realize this, however, it is necessary that a trailing gripper margin of the sheet be gripped securely by the trailing edge grippers. But the published German Patent Document DE 42 18 421 A1 does not disclose any way of satisfying this requirement.

German Patent 627 851 offers a proposal for realizing the grasping or gripping of the trailing gripper margin by trailing edge grippers. According to this proposal, the sheet is transferred from an impression cylinder by leading edge grippers and is drawn by a first chain drive including the leading edge grippers over guide rails extending along the bottom strands of the first chain drive, namely the strands which pull the sheet, beneath these strands. Beneath these strands a second chain drive is disposed having upper strands which move in the same direction as the lower strands of the first chain drive. The second chain drive bears trailing edge grippers, which grasp the trailing gripper margin when this margin of the sheet which is supported on the guide rails reaches a location at which the upper strands of the second chain drive leave a diverting wheel or guide roller that is situated upline relative to the direction of motion of these upper strands. The trailing gripper margin of the sheet is blocked from dropping below a prescribed level by the guide rails; there is no assurance, however, that the gripper margin will not make a flapping or whipping movement after running onto the guide rails. Besides the foregoing, this construction is suitable only for first-form or single-side printing, and then only if any marks which may occur on the nonprinted side of the sheet due to a rubbing thereof across the guide rails be taken into consideration, which is highly doubtful, particularly when the obverse or reverse side of the sheet is subsequently printed in a later pass or run.

SUMMARY OF THE INVENTION

It is accordingly an object of the invention to provide a device for transporting a printed sheet for a rotary printing machine without smearing, the transporting device being produced without having to resort to the use of stationary guiding devices.

With the foregoing and other objects in view, there is provided, in accordance with one aspect of the invention, a device for transporting a sheet for a sheet-processing machine in a processing direction, comprising first grippers for gripping the sheet at a leading gripper edge, as viewed in the direction of processing, the first grippers revolving in a first direction during operation; a cylinder bearing the first grippers, the cylinder having a support surface formed at the circumference thereof for supporting the sheet gripped by the first grippers; second grippers for taking over the leading gripper edge of the respective sheet from the first grippers, the second grippers revolving in a second direction opposite to the first direction; and at least one pair of sheet supports rotating about a rotational axis and formed with a pitch surface disposed concentric with the rotational axis, the pitch surface having an extent along the rotational axis less than the width of a respective nonprinted lateral margin of the respective sheet, and serving to press the sheet against the support surface within a respective lateral margin in regions of common normals of the support surface and the pitch surfaces; and suction grippers revolvable in the second direction and for taking over from the cylinder a trailing gripper margin of the sheet which has been placed on the support surface of the cylinder by the sheet supports.

In accordance with another feature of the invention, the transport device includes a sheet guiding drum comprising the second grippers, the sheet supports and the suction grippers.

In accordance with a further feature of the invention, the transport device includes a transfer drum connected in series with the sheet guiding drum and operationally rotating in the first direction, the transfer drum having third grippers for taking over the leading gripper margin from the second grippers, and having suckers following the third grippers for taking over the trailing gripper margin from the suction grippers; and an operationally revolving continuous conveyor including pregrippers and post-grippers, whereof the pregrippers are for taking over the leading gripper margin from the third grippers, and the post-grippers are for taking over the trailing gripper margin from the suckers.

In accordance with an added feature of the invention, the transport device includes an operationally revolving continuous conveyor comprising the second grippers, for taking over the leading gripper margin of the respective sheet from the first grippers, and trailing edge grippers for taking over the trailing gripper margin of the respective sheet from the suction grippers.

In accordance with an additional feature of the invention, the trailing edge grippers grasp the trailing gripper margin in an outlet wedge of a nip formed between the support surface and the pitch surfaces.

In accordance with yet another feature of the invention, the sheet supports have an adjustable mutual spacing.

In accordance with yet a further feature of the invention, the pitch surfaces have an adjustable circumferential extent.

In accordance with yet an added feature of the invention, the suction grippers have an adjustable phase position.

In accordance with yet an additional feature of the invention, the suckers have an adjustable phase position.

In accordance with another aspect of the invention, there is provided a sheet-processing machine including a device for transporting a sheet in a processing direction, the sheet-transporting device comprising first grippers for gripping the sheet at a leading gripper edge, as viewed in the direction of processing, the first grippers revolving in a first direction during operation; a cylinder bearing the first grippers, the cylinder having a support surface formed at the circumference thereof for supporting the sheet gripped by the first grippers; second grippers for taking over the leading gripper edge of the respective sheet from the first grippers, the second grippers revolving in a second direction opposite to the first direction; and at least one pair of sheet supports rotating about a rotational axis and formed with a pitch surface disposed concentric with the rotational axis, the pitch surface having an extent along the rotational axis less than the width of a respective nonprinted lateral margin of the respective sheet, and serving to press the sheet against the support surface within a respective lateral margin in regions of common normals of the support surface and the pitch surfaces; and suction grippers revolvable in the second direction and for taking over from the cylinder a trailing gripper margin of the sheet which has been placed on the support surface of the cylinder by the sheet supports.

In accordance with a further aspect of the invention, there is provided a rotary printing machine including a device for transporting a sheet in a processing direction, the sheet-transporting device comprising first grippers for gripping the sheet at a leading gripper edge, as viewed in the direction of processing, the first grippers revolving in a first direction during operation; a cylinder bearing the first grippers, the cylinder having a support surface formed at the circumference thereof for supporting the sheet gripped by the first grippers; second grippers for taking over the leading gripper edge of the respective sheet from the first grippers, the second grippers revolving in a second direction opposite to the first direction; and at least one pair of sheet supports rotating about a rotational axis and formed with a pitch surface disposed concentric with the rotational axis, the pitch surface having an extent along the rotational axis less than the width of a respective nonprinted lateral margin of the respective sheet, and serving to press the sheet against the support surface within a respective lateral margin in regions of common normals of the support surface and the pitch surfaces; and suction grippers revolvable in the second direction and for taking over from the cylinder a trailing gripper margin of the sheet which has been placed on the support surface of the cylinder by the sheet supports.

To achieve the objects of the invention, the transporting device is equipped with suction grippers which revolve during operation in the second direction, the suction grippers taking up from the cylinder a trailing gripper margin of the respective sheet, which has been placed on the support surface of the cylinder by the sheet supports.

With this transporting device, the sheet that has been grasped by the second grippers is first peeled from the support surface of the cylinder that bears the first grippers, the respective peeled-off portion of the sheet extending from the second grippers to the common normals of the support surface and the pitch surfaces. The second grippers travel along an arc-shaped path after passing the common normals. The side margins of the portion of the sheet that has been peeled from the support surface, which represent nonprinted zones, are thus wound onto the pitch surfaces of the sheet supports. The bending forces which this exerts upon the sheet by way of the first gripper give rise to opposing reactive forces of the sheet, which bias or prestress the portions of the yet unwound sheet towards the support surface of the cylinder. The invention exploits this effect, which causes these reactive forces to press a trailing gripper margin of the sheet against the support surface as well, so that this gripper margin is placed on the support surface orthogonally when passing the common normals and is therefore available for a defined grasping by the gripping mechanisms, which are realized as suction grippers, in view of the support surface of the cylinder, which forms a closed surface. After the trailing gripper margin has been successfully accepted by the suction grippers, the sheet is stable on all of the margins thereof; it is thus accessible for secure grasping by mechanically opening and closing grippers particularly at the trailing gripper margin, and it is possible to transport the sheet further under positive guidance of both the leading and trailing gripper margins thereof.

In a preferred development, a sheet guiding drum is provided which comprises the second grippers, the sheet supports, and the suction grippers.

In a preferred application thereof, in the case of a serially constructed rotary printer, such a sheet guiding drum serves to transport the sheet from one processing station, for example, a printing unit, to the next processing station, for example, an additional printing unit or a varnishing unit, and so on, and it spares sheet guiding mechanisms (which are typically pneumatic) that are needed between the processing stations in conventional sheet transferring devices.

A further development provides for a transfer drum to be connected in series with the sheet guiding drum and to rotate in the first direction during operation, the transfer drum having third grippers which take over the leading gripper margin from the second grippers, and having suckers following the third grippers, which take over the trailing gripper margin from the suction grippers; and by continuous conveyors comprising operationally revolving pregrippers and post-grippers, of which the pregrippers take over the leading gripper margin from the third grippers, and the post-grippers take over the trailing gripper margin from the suckers.

In a preferred development of the transfer drum, it comprises sheet supports in the same manner as the sheet guiding drum, the sheet supports having pitch surfaces which are concentric with the rotational axis of the transfer drum and which press the sheet against the sheet guiding drum within the side margins of the sheet exclusively, namely in regions of common normals of the pitch surfaces of the sheet guiding drum, on the one hand, and of the transfer drum, on the other hand.

In another development, which is specifically suitable for guiding sheets for one-sided or first-form printing or in a second pass through the rotary printing machine, the transfer drum has a plurality of pitch surfaces concentric with the rotational axis thereof, which follow one another in the axial direction of the transfer drum, with intervening spaces. The intervening spaces are dimensioned to accommodate the suckers and, in a preferred development, to allow the post-grippers to drop into the same intervening space wherein a sucker is disposed.

With the continuous conveyor, the sheet can then be transported by positively guiding the leading and trailing gripper margins thereof, namely in a direction towards a stacking or pile station of the rotary printing machine, without requiring conventional guiding devices for smear-free sheet guidance.

In another development, the aforedescribed transporting device constructed in accordance with the invention, namely, with suction grippers which revolve, during operation, in the second direction and which take over from the cylinder a trailing gripper margin of the sheet that has been placed onto the support surface of the cylinder by the sheet supports, comprises a continuous conveyor which revolves during operation, including the second grippers which are provided for taking over the leading gripper margin from the first grippers, as well as, trailing edge grippers which take over the trailing gripper margin from the suction grippers.

The continuous conveyor herein provided can be used in the aforedescribed manner for transporting the sheet in a direction towards a stacking or pile station and can be arranged for this purpose directly downline from the cylinder bearing the first grippers, this cylinder having a support surface for supporting the sheet holohedrally, as is the case with an impression cylinder, in particular.

In a preferred development of the continuous conveyor that immediately follows the cylinder, the trailing edge grippers thereof grasp the trailing gripper margin in the outlet wedge of the gap formed between the support surface and the pitch surfaces. This makes possible measures by which the trailing edge grippers of the continuous conveyor can pass through the regions of common normals of the support surface of the cylinder and the pitch surfaces of the sheet supports without colliding. It is common to the measures provided for this purpose that the trailing edge grippers pass the cylinder inside an envelope that can be placed about the revolving suction grippers.

In another preferred development, provision is made for the mutual spacing between the sheet supports to be adjustable so as to make it possible to process sheets with different widths relative to the processing direction.

Another preferred development provides for the circumferential extent of the pitch surfaces to be adjustable. Also provided for is that the phasing or phase position of the suction grippers and of the suckers be adjustable.

These measures make possible the processing of sheets with different lengths relative to the processing direction.

Other features which are considered as characteristic for the invention are set forth in the appended claims.

Although the invention is illustrated and described herein as embodied in a device for transporting a sheet for a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
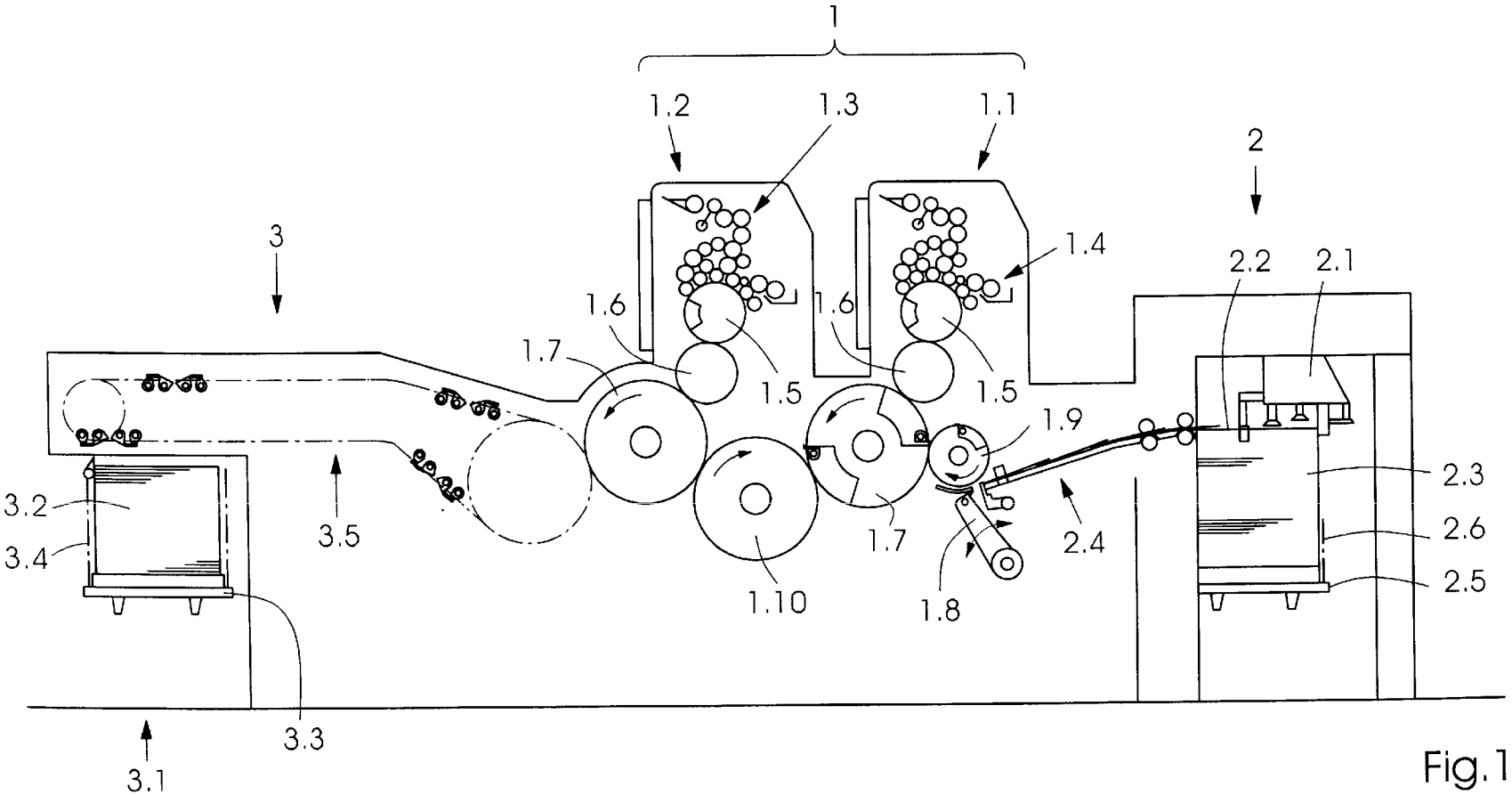
FIG. 1 is a diagrammatic side elevational view of a sheet-processing machine exemplified as a rotary printing machine of unit construction, the machine being equipped with devices for transporting the sheets, which are not illustrated in detail.

Referring now to the drawings and, first, particularly to FIG. 1 thereof, there is shown therein a sheet-fed rotary printing press including a section 1 thereof having two exemplary processing stations in the form of printing units 1.1 and 1.2, so that two colors can be printed therewith. An additional printing unit must be provided for printing each additional color. For each additional processing step such as varnishing, drying, perforating and so forth, an additional processing station must also be provided. In the exemplary embodiment represented herein, the printing units 1.1 and 1.2 operate by the wet offset method, and each printing unit 1.1,1.2 includes a respective inking unit 1.3 and a respective dampening unit 1.4, a respective plate cylinder 1.5 connected thereto, a respective rubber blanket cylinder 1.6 rolling on the respective plate cylinder during operation, and a respective impression cylinder 1.7 for guiding each sheet, respectively.

To supply the printing units 1.1 and 1.2 with sheets, a sheet feeder 2 is provided, which grasps a respective top sheet 2.2 from a pile 2.3 by a separator or singling device 2.1, and transfers it to a transporting and aligning device 2.4, which, after a respective leading sheet, as viewed in the processing direction, of the sheets which have been singly deposited into an imbricated formation, has been transported in a direction towards leading edge stops, namely by a table of suction tapes, aligns the sheet at the stops and at least at one lateral stop.

A swiveling pre-gripper 1.8 assigned to the first processing station, a printing unit 1.1 in this case, takes over the respectively aligned sheet 2.2 and transfers it to a feeding drum 1.9, which transfers it to the impression cylinder 1.7 of the printing unit 1.1. After the sheet 2.2 passes through a nip between the impression cylinder 1.7 and the blanket cylinder 1.6 of this printing unit 1.1, the impression cylinder 1.7 transfers the sheet 2.2 to a transfer device in the form of a sheet guiding drum 1.10, which is connected between the impression cylinders 1.7 of the two printing units 1.1 and 1.2 and which is described hereinafter in greater detail. The impression cylinder 1.7 of the printing unit 1.2 takes over the sheet from the sheet guiding drum 1.10, guides it through the additional nip between the impression cylinder 1.7 and the blanket cylinder 1.6 of the printing unit 1.2, and transfers it to a transfer device including a continuous conveyor 3.5 revolving during operation (described in greater detail hereinbelow), which transports the respective sheet 2.2 to a stacking or pile station 3.1 and releases it thereat, forming a printed product pile.

In production or continuous printing operations, the production level, i.e., the height of the respective top sheet 2.2 of the pile 2.3 in the feeder 2, and the drop height of the released sheets 2.2 in the stacking or pile station 3.1 are maintained by readjusting the platforms 2.5 and 3.3, respectively, which bear the sheet pile 2.3 and the product stack 3.2, respectively, by respective lifting units, of which only the lift chains 2.6 and 3.4, which bear the platforms 2.5 and 3.3, are represented in phantom.

Figure 2:
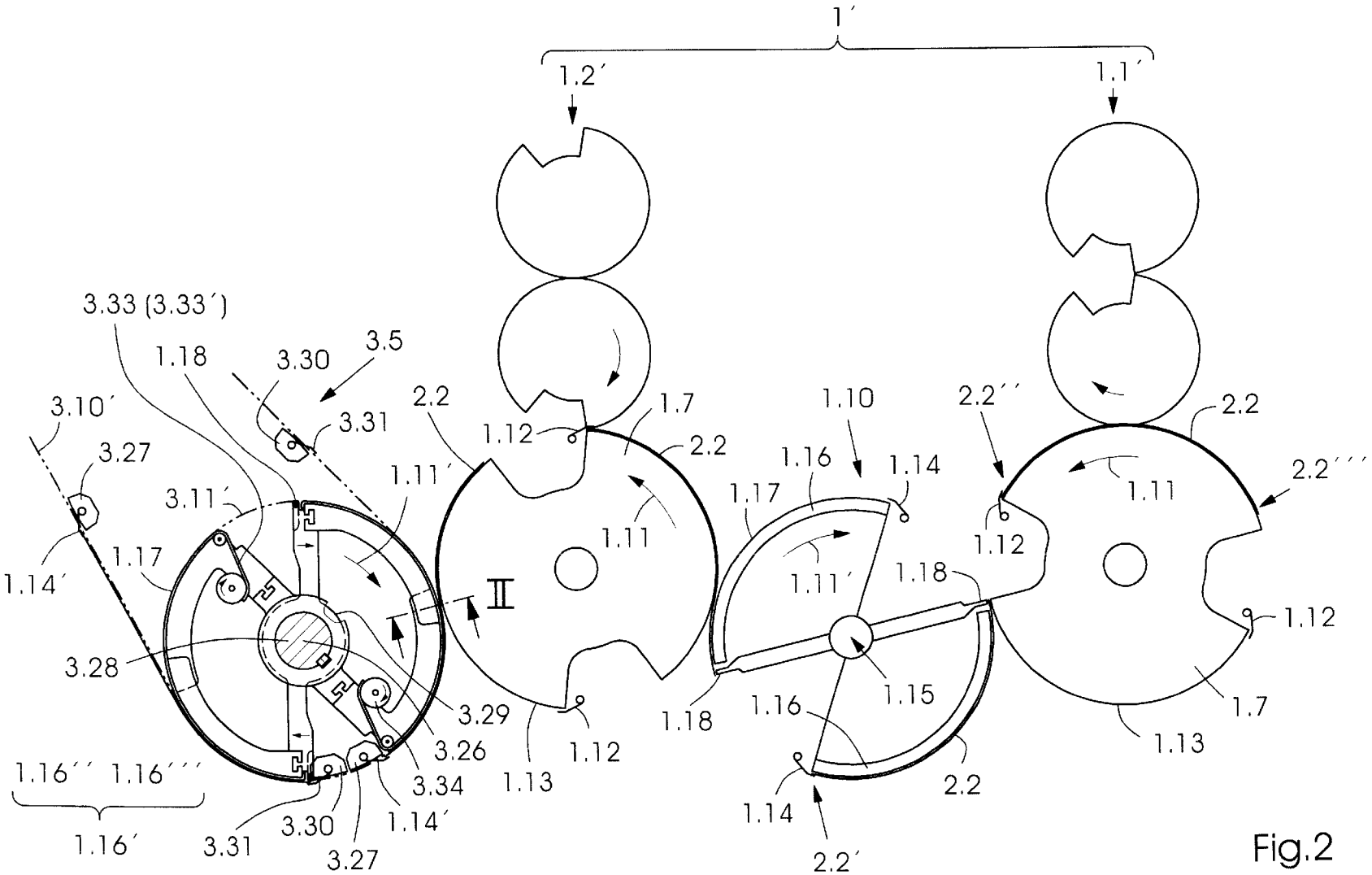
FIG. 2 is an enlarged fragmentary view of FIG. 1, showing schematicaly an example of the arrangement of printing unit cylinders of a sheet-fed rotary printing machine of unit construction, and transfer devices for the sheets being processed.

The constellation of printing unit cylinders and transfer devices represented in FIG. 2 corresponds at least approximately to that represented in FIG. 1 and represents two successive printing units 1.1' and 1.2' of a printing machine section 1', wherein one of the transfer devices transports the sheets 2.2 from one impression cylinder 1.7 to the other. This transfer device includes first grippers 1.12 which revolve in a first direction in accordance with the arrow 1.11 during operation, and which hold a sheet 2.2 that has been fed to the printing machine section 1' at the leading gripper margin 2.2" of the respective sheet 2.2, as viewed in the processing direction, and a cylinder, here the impression cylinder 1.7, which bears the first grippers 1.12, the circumference of the impression cylinder 1.7 forming a support surface 1.13 for the sheet 2.2 that is grasped by the first grippers 1.12. The one transfer device 1.1. also has second grippers 1.14 revolving in a second direction (indicated by the arrow 1.11'), which is opposite to the first direction 1.11. The grippers 1.14 pass the first grippers 1.12 in a combing manner and take over the leading gripper margin 2.2" of the sheet 2.2 therefrom. It is noted that, contrary to the rather simplified representation, the second grippers 1.14 are formed by gripper fingers and gripper finger rests which revolve in a like manner and to the same extent as these fingers.

The one transfer device 1.10 also includes at least one pair of sheet supports 1.16 which revolve about a rotary shaft 1.15 in the second direction, indicated by the arrow 1.11', (in the exemplifying embodiment of FIG. 2, there are two pairs of sheet supports 1.16 with semi-rotational second grippers 1.14), each of the sheet supports 1.16 having a pitch surface 1.17 concentric with the rotary shaft 1.15, and having an extent along the rotary shaft 1.15 which is less than the width of a respective nonprinted side margin of the sheet 2.2. Each pitch surface 1.17 follows the second grippers 1.14 and adjoins them.

The extent of the pitch surfaces 1.17 in the circumferential direction thereof at least approximately corresponds to the extent in the processing direction of the largest sheet that can possibly be processed by the rotary printing machine. Furthermore, the sheet supports 1.16 are dimensioned and disposed in a manner that the pitch surfaces thereof press a respective sheet 2.2 against the support surface 1.13 in the nonprinted side margins 2.2' thereof in regions of common normals of the pitch surfaces 1.17 and the support surface 1.13, while the second grippers 1.14, which are holding the leading gripper edge 2.2" tight, peel from the support surface 1.13 the sheet 2.2 that has been taken from the first grippers 1.12 by the second grippers, and wind it onto the pitch surfaces 1.17.

Finally, the one transfer device 1.10 has suction grippers 1.18 which revolve in the second direction as represented by arrow 1.11' during operation and which take over, by the sheet supports 1.16, from the impression cylinder 1.7, a trailing gripper margin 2.2'" of the sheet 2.2, which has been placed on the support surface 1.13 of the impression cylinder 1.7. To this end, the suction grippers 1.18 are formed with suction openings which open into an envelope that can be placed about the pitch surfaces 1.17 of the sheet supports 1.18, and they follow the second grippers 1.14 in a phasing according to which, in the operational revolution thereof they pass the impression cylinder 1.7 at a time at which these suction openings are situated opposite the trailing gripper margin 2.2'".

By this instant of time, the sheet 2.2 has already been clamped into or gripped by the second grippers 1.14 and wound onto the pitch surfaces 1.17, and from this time forward the trailing gripper margin 2.2'" of the sheet 2.2 is guided in a defined manner by the suction gripper 1.18.

The transfer of a sheet, which has been stabilized in this manner, to the impression cylinder 1.7 of the printing unit 1.2', which is the ultimate aim of the transfer device, is then accomplished in a manner that the first grippers 1.12 of the succeeding impression cylinder 1.7, which correspond to the first grippers 1.12 at the impression cylinder 1.7 of the printing unit 1.1', take over the sheet 2.2 from the second grippers 1.14. In this respect, the second grippers 1.14, the sheet supports 1.16, and the suction grippers 1.18 represent components of the sheet guiding drum 1.10.

Figure 3:
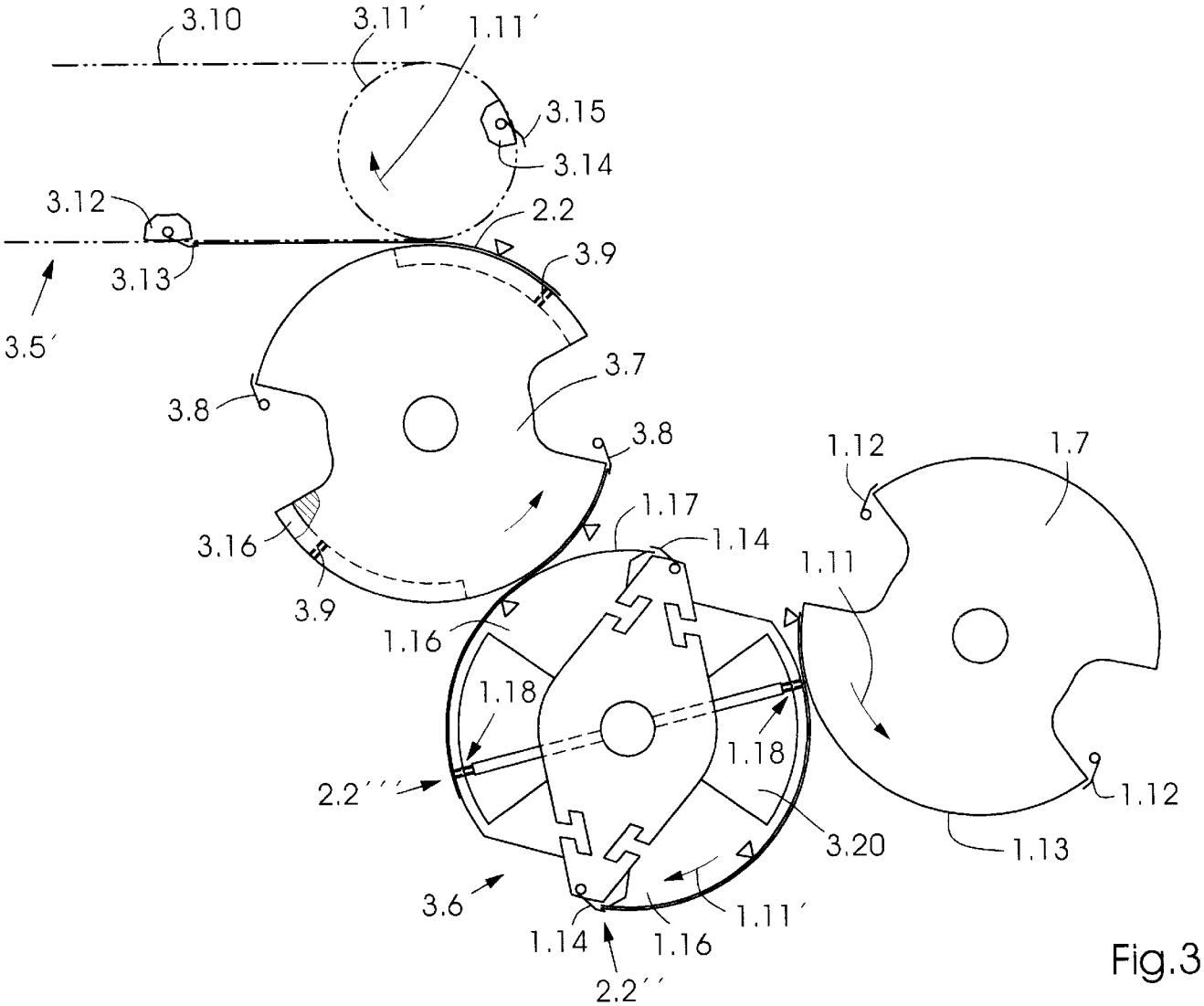
FIG. 3 is a schematic view like that of FIG. 2 showing a transfer device for delivering the processed sheet from a rotary printing machine.

FIG. 3 illustrates a preferred introduction or use of a sheet guiding drum 3.6 which mirrors the sheet guiding drum 1.10, here representing a component of a transfer device for delivering the sheets 2.2 that have been processed in the printing units 1.1 and 1.2 or 1.1' and 1.2', respectively. The sheet guiding drum 3.6 is connected in series with a final sheet guiding cylinder which, in the exemplary embodiment of FIG. 3, is the impression cylinder 1.7 of the printing unit 1.2 or 1.2', and it works in conjunction therewith in the manner described in connection with the sheet guiding drum 1.10.

The transfer device provided for delivering the processed sheet 2.2 preferably additionally includes a transfer drum 3.7 that is connected in series with the sheet guiding drum 3.6 and that rotates in the first direction during operation, i.e., in the rotational direction of the impression cylinder 1.7, this drum having third grippers 3.8 which pass, in a combing manner, the second grippers 1.14, which are disposed at the sheet guiding drum 3.6 in this example, and which take over the leading gripper margin 2.2' from the grippers 1.14. Suckers 3.9 are also provided on the transfer drum 3.7 and take over the trailing gripper margin 2.2" of the sheet 2.2 from the suction grippers 1.18, which are arranged on the sheet guiding drum 3.6 in this example.

A continuous or endless conveyor 3.5' is connected to the transfer drum 3.7, and has a principal structure corresponding to that of the continuous conveyor 3.5 represented in FIGS. 1 and 2, with the exception of differences described elsewhere herein. The continuous conveyor 3.5' includes two pairs of chains 3.10 which revolve, during operation, in the second direction as represented by the arrow 1.11'. Each chain 3.10 of the pair thereof is looped around a diverter or deflecting member and one of four coaxial sprocket wheels 3.11 which rotate synchronously during operation and which are disposed pairwise at mutual spaced intervals which are greater than the extent, transverse to the processing direction, of the largest possible sheet that can be processed in the printing machine section 1 or 1'. Gripper bars 3.12 extend between the chains 3.10 of a first of the two chain pairs, and are borne by the chains 3.10, pregrippers 3.13 for grasping the leading gripper margin 2.2' being disposed on the gripper bars 3.12. Gripper bars 3.14 extend between the chains 3.10 of a second of the two chain pairs, and are borne by these chains 3.10, post-grippers 3.15 for grasping the trailing gripper margin 2.2''' being disposed on the gripper bars 3.14. The phase positions of the pregrippers 3.13 and the post-grippers 3.15 are calibrated so that the pregrippers 3.13 take over the leading gripper margin 2.2'' of the sheet 2.2 from the third grippers 3.8, and the post-grippers 3.15 take over the trailing gripper margin 2.2''' of the sheet 2.2 from the suckers 3.9.

Figure 4:
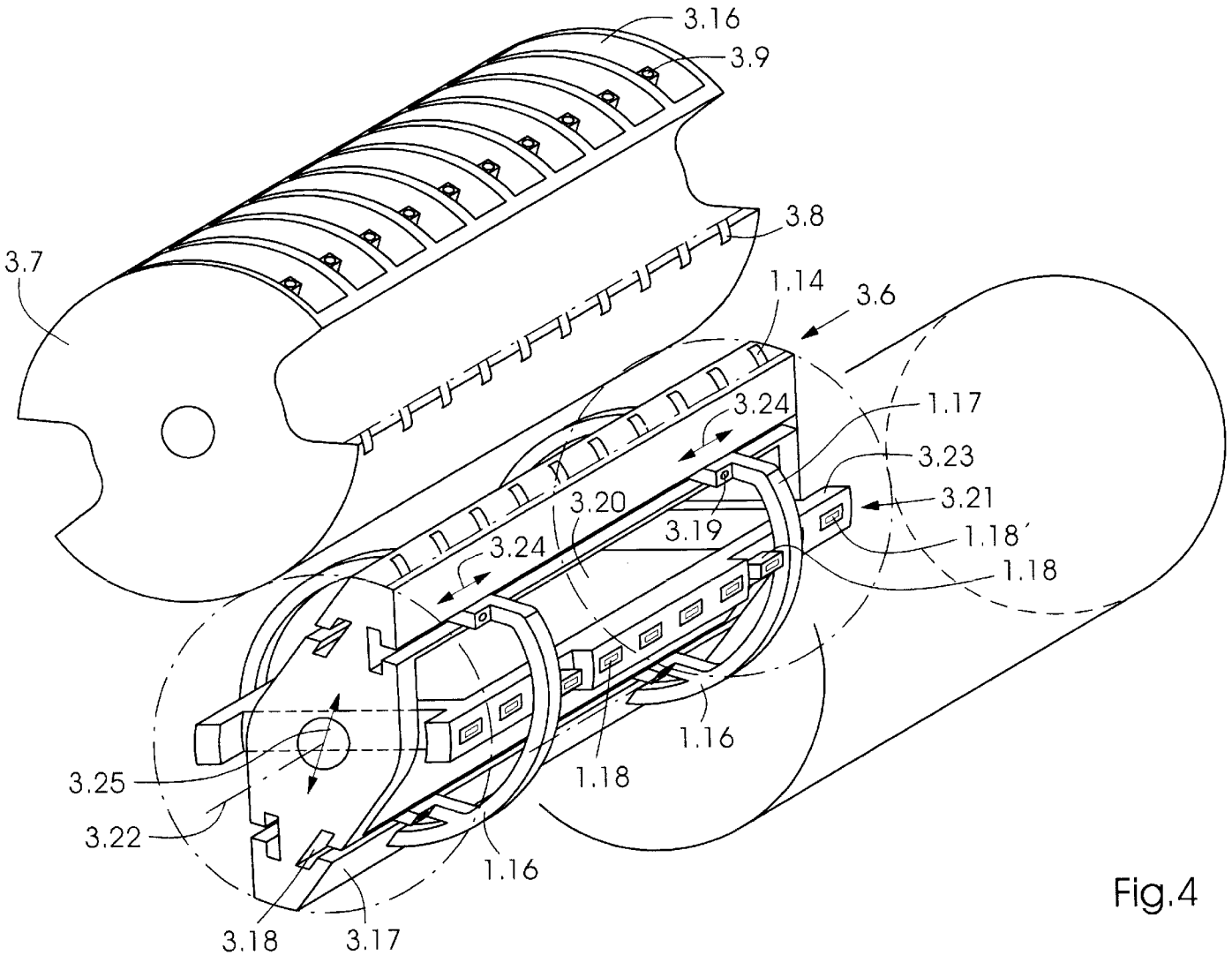
FIG. 4 is a perspective view of a transfer device corresponding to that of the constellation shown in FIG. 3.

FIG. 4 shows a simplified spatial view of a sheet guiding drum and a transfer drum, which operate as described in connection with FIG. 3, in conjunction with one another and with the impression cylinder 1.7 as represented in FIG. 3, on the one hand, and with the continuous conveyor 3.5' as represented in FIG. 3, on the other hand, so that the components in FIG. 4 which correspond to those in FIG. 3 are provided with like reference characters as in FIG. 3, notwithstanding constructional differences which do not affect function. The same is true of the reference characters in FIGS. 2 and 3.

FIG. 4 specifically clarifies details not apparent from FIGS. 2 and 3, which serve to adjust or adapt the transfer device to various formats of the sheets 2.2.

In the case of the sheet guiding drum 3.6 and the sheet guiding drum 1.10 (note FIG. 2), adjustment or adaptation to the extent or dimension of the respective sheets 2.2 in the direction of processing is accomplished by adjusting a corresponding phase angle of the suction grippers 1.18 relative to the second grippers 1.14; in the case of the transfer drum 3.7, by adjusting a corresponding phase angle of the suckers 3.9 relative to the third grippers 3.8; and in the case of the continuous conveyor 3.5', by adjusting a corresponding phasing or phase position of the post-grippers 3.15 relative to the pre-grippers 3.13.

In the case of a transfer drum 3.7 as represented in the exemplary embodiments of FIGS. 3 and 4, which are provided with a lateral surface jacket, for adjusting the phasing or phase position of the suckers 3.9, circumferential grooves 3.16 are formed in the lateral surface of the drum, along which the suckers 3.9 which are arranged therein are movable in a non-illustrated manner. These circumferential grooves 3.16 are formed with a mutual spacing therebetween, a width, and a depth of such dimension that the post-grippers 3.15, which are arranged at spaced intervals along each gripper bar 3.14 and which comb with the suckers 3.9 which form a sucker row in order to take over the sheet 2.2 therefrom, drop in this takeover process into the same circumferential groove wherein a sucker 3.9 is also disposed. The surface of the jacket of the drum is preferably constructed so as to be ink-repellent.

The pregrippers 3.13 and the post-grippers 3.15 are preferably spring-biased in the closing direction in a conventional manner and are opened by roller follower mechanisms, which are actuated on their part by control cams and which, in a gripper opening process, turn a gripper shaft which has a connection to the pregrippers 3.13, which is fixed against relative rotation, or a shaft which has a connection to post-grippers 3.15, which is fixed against relative rotation, respectively, at a defined angle as required. In the development represented in FIG. 3, the pregrippers 3.13 and the post-grippers 3.15 travel along paths which lie on one and the same surface. But this is not mandatory. What is essential only is that both paths, respectively, include common normals with an envelope enclosing the transfer drum 3.7 in the circumferential direction thereof, and that from the grasping of the trailing gripper margin 2.2''' until a later release of the sheet 2.2, the spaced distance between the pregrippers 3.13 and the post-grippers 3.15 guiding a sheet always be varied an acceptable or permissible amount. Specifically, an unacceptable spaced distance change would be such an enlargement of the spaced distance that the sheet 2.2 would be pulled out of the pregrippers 3.13 or post-grippers 3.15. An acceptable and preferably provided spaced distance change is a preferably temporary reduction of the spaced distance to such an extent as to allow the sheet 2.2 to develop a crease in a gap of an unrolling device. An unrolling device that is provided for this purpose is preferably constructed so that it avoids the gripper bars 3.12 and 3.14. Sagging of the sheets 2.2 in the region of a diversion or deflection of the continuous conveyors 3.5 and 3.5', respectively, is counteracted by blast air.

In order to be able to transport sheets of different formats using the described transfer devices, it is necessary not only to calibrate the components that work in conjunction with the trailing gripper margin 2.2''' to the respective phasing or phase position thereof relative to the grippers which grasp the leading gripper margin but also to calibrate the sheet supports 1.16 to the nonprinted side margins 2.2' of the sheets 2.2. To this end, it is possible to adjust the spaced distance of the sheet supports 1.16 acting in pairs on a sheet 2.2.

FIG. 4 is an example of a development of the sheet guiding drum 3.6 that is suited to this purpose which, in like construction, also fulfills the function of the sheet guiding drum 1.10 represented schematically in FIG. 2.

The sheet guiding drum 3.6 includes a drum core 3.17, at which the second grippers 1.14 are disposed (here shown only schematically), which are also biased in a closing direction in a conventional manner and opened, as needed, by roller follower mechanisms and control cams which actuate them. In the example at hand, the drum core 3.17 is provided with T-slots 3.18 extending along the length of the sheet guiding drum 3.6 and accepting T-shaped feet provided at the sheet supports 1.16, the T-shaped feet being clampable in the T-slots 3.18 by clamping screws 3.19.

The drum core is additionally formed with a recess 3.20 wherein a suction device 3.21 is disposed so that it is pivotable relative to the rotary shaft 3.22 of the sheet guiding drum 3.6, and locked in place. The suction device 3.21 forms a suction air shaft 3.23 extending along the sheet guiding drum 3.6 that is connected to a low-pressure generator in a non-illustrated manner. The suction grippers 1.18 have suction openings 1.18' which communicate with the interior of the suction air shaft 3.23 and which terminate in the region between the sheet supports 1.16 in an envelope surface that is spread by the pitch surfaces 1.17. In the region of the extent, transverse to the processing direction, of a sheet 2.2 with the smallest processible format, the suction grippers 1.18 are preferably fixedly connected to the suction air shaft 2.23, whereas the suction grippers 1.18 outside the smallest format can be adjusted in the direction of the rotary shaft 3.22 SO as to make it possible to adjust the sheet supports 1.16 in the directions of the double arrow 3.24 in order to be able to adjust the sheet supports 1.16 to the nonprinted side margins 2.2' of the sheets 2.2.

The pitch surfaces 1.17 of the sheet supports 1.16 which are provided at the sheet guiding drums 3.6 and 1.10 are preferably formed on a non-illustrated elastic coating of the sheet supports 1.16 with a hardness preferably over some 50 Shore. Thus, small variations in the thickness of the processed sheets 2.2 can be compensated for. Alternatively, the pitch surfaces 1.17 are formed at running strips that can be correspondingly underlaid. This makes it possible to adapt or adjust to larger variations of the thickness of sheets 2.2. In case sheets 2.2 of notably different thicknesses are being processed, the rotary shaft 3.22 of the sheet guiding drum 3.6 is also displaceable in the direction of the double-headed arrow 3.25 (note FIG. 4) in order to press the pitch surfaces 1.17 under a sufficient pressing force to the side margins 2.2' of the sheet 2.2 lying on the support surface 1.13.

Whereas, in the transfer device that has just been described with reference to FIGS. 3 and 4, the sheets 2.2 are delivered by transferring them indirectly from the last processing station to a continuous conveyor (here the continuous conveyor 3.5'), in another development, in the transfer device represented in FIG. 2 for delivering the sheets 2.2 , the sheets are transferred from the last processing station (here printing unit 1.2') to a continuous conveyor 3.5 which directly passes the last processing station. This continuous conveyor is constructed analogously to the continuous conveyor 3.5' previously described, and also includes two chain pairs which revolve in the second direction indicated by the arrow 1.11' during operation. Each chain 3.10' of the respective pair surrounds one of four identical sprocket wheels 3.11' rotating synchronously during operation, which are spaced analogously relative to the continuous conveyor 3.5' and which have a common rotary shaft 3.26. A first chain of this pair of chains bears gripper bars 3.27, at which the second grippers, identified by reference character 1.14' here, are arranged, and provided for taking over the leading gripper margin 2.2' from the first grippers 1.12.

As in the case of the sheet guiding drums 1.10 and 3.6, sheet supports 1.16' are provided, which rotate in this case together with the sprocket wheels 3.11', and form pitch surfaces 1.17 concentric with the rotary shaft 3.26 of the sprocket wheels 3.11' and which press the side margins 2.2' of the sheet 2.2 against the support surface 1.13 of the impression cylinder 1.7 of the printing unit 1.2' as the sheets 2.2 that have been grasped by the second gripper 1.14' are peeled from the support surface 1.13 and wound onto the pitch surfaces 1.17. The sheet supports 1.16' follow the second grippers 1.14 and ultimately adjoin them after a gripper bar 3.27 bearing them has dropped into the rotational path of the pitch surfaces 1.17 and rotates together with the sheet supports 1.16' on one rotational path, until the chain pair bearing the gripper bar 3.27 exits the corresponding pair of sprocket wheels 3.11'.

In contrast with the sheet supports 1.16 of the sheet guiding drums 1.10 and 3.6, the circumferential extent of the sheet supports 1.16' is adjustable, namely for purposes of adapting to different extents of the processed sheet 2.2 in the direction of processing. To this end, each sheet support 1.16', respectively, is bifurcated in the circumferential direction of the pitch surfaces 1.17. In the example at hand, a leading sheet support portion 1.16" is connected, fixed against relative rotation, to a sprocket shaft 3.28, and the latter is connected, fixed against relative rotation, to each sprocket wheel 3.11', the sprocket wheels 3.11' having the chain pair bearing the gripper bars 3.27 with the two grippers 1.14' looped around them. A succeeding sheet support portion 1.16'" is connected, fixed against relative rotation, to a hollow shaft 3.29 that is concentric with the sprocket shaft 3.28, the hollow shaft 3.29 being, in turn, connected, fixed against relative rotation, that sprocket wheel 3.11' which has the chain pair looped around it that bears gripper bars 3.30 at which trailing edge grippers 3.31 for grasping the trailing gripper margin 2.2'" of the sheet 2.2 are disposed. In the example at hand, for the connection, fixed against relative rotation, of the sheet support portions 1.16" and 1.16'" to the sprocket shaft 3.28 and the hollow shaft 3.29, respectively, ribs are provided in the manner of spokes, relative to which each sheet support portion 1.16" and 1.16'" can be adjusted in the longitudinal direction of the sprocket shaft 3.28 and locked in an otherwise non=illustrated manner. Analogously to the sheet supports 1.16 of the sheet guiding drum 3.6 in FIG. 4, the sprocket shaft 3.28 is displaced along T-shaped guidances. In this example, to adjust the extent of the pitch surfaces 1.17, the phasing or phase position of the hollow shaft 3.29 relative to the sprocket shaft 3.28 is adjusted.

Figure 2A:
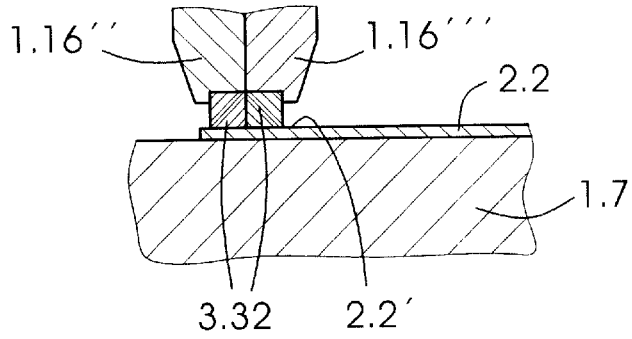
FIGS. 2*a* to 2*c* are fragmentary sectional views of FIG. 2, taken along the line II in the direction of the arrows, in various embodiments.
Figure 2B:
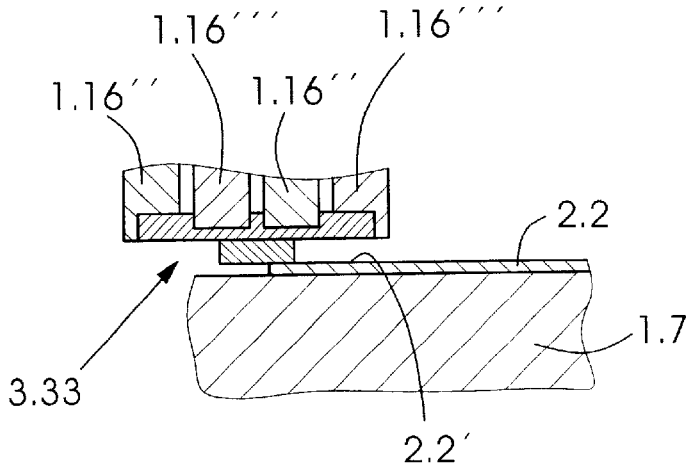
Figure 2C:
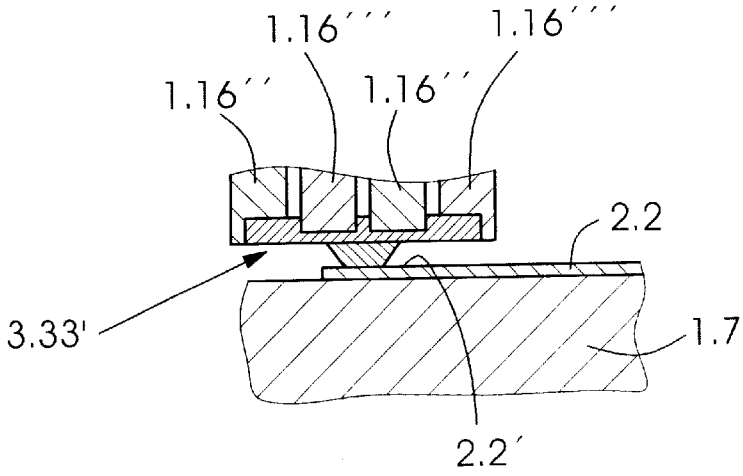

FIGS. 2*a* to 2*c* represent developments of the sheet support portions 1.16" and 1.16'" that are suited to this purpose. In a first development in accordance with FIG. 2*a*, each of the two sheet support portions 1.16" and 1.16'" is provided with a flexible rubber running strip 3.32 forming the pitch surfaces 1.17, which is fixed in place by vulcanization, for example, so that the two running strips 3.32 act in adjacent tracks of the side margins 2.2'.

In the developments according to FIGS. 2*b* and 2*c* which act on different regions of the side margins 2.2', the sheet support portions 1.16" and 1.16'" are laminated and include a common running strip 3.33 or 3.33', respectively. In this embodiment, as represented in FIG. 2, this running strip is fixed at the trailing end of the sheet support portions 1.16'" and can be wound and unwound at the leading end of the sheet support portions 1.16" by a winding mechanism 3.34, which is preferably biased to shorten the unwound running strip 3.33 and 3.33', respectively. The running strips 3.33 and 3.33', respectively, preferably comprise a carrier tape which is resistant to expansion.

The running strips 3.32, 3.33 and 3.33', respectively, are preferably sufficiently elastic to adapt or adjust to a wide variety of thicknesses of the sheets 2.2 which are being processed.

The transfer device for delivering the sheets 2.2 also comprises suction grippers 1.18 disposed downline from sheet supports 1.16' and revolving together therewith, which lift the trailing gripper margin 2.2'" from the support surface 1.13 of the impression cylinder 1.7 of the printing unit 1.2'. These suction grippers 1.18 form a row extending transversely to the processing direction and are disposed so that they comb with the trailing edge grippers 3.31 when the latter drop into the rotational path of the pitch surfaces 1.17. The trailing edge grippers 3.31 pass the regions of common normals of the support surfaces 1.13 and the pitch surfaces 1.17 radially within the path traveled by the pitch surfaces 1.17 and take over the trailing gripper margin 2.2'" from the suction grippers 1.18 in the outlet wedge of the nip formed between the support surface 1.13 and the pitch surfaces 1.17. Herein lies a difference, which has been noted hereinbefore, between the constructions of the continuous conveyors 3.5 and 3.5'.

We claim:

1. A device for transporting a sheet for a sheet-processing machine in a processing direction, the device comprising:

first grippers for gripping the sheet at a leading gripper margin, as viewed in the direction of processing, said first grippers revolving in a first direction during operation;

a cylinder bearing said first grippers said cylinder having a support surface formed at the circumference thereof for supporting the sheet gripped by said first grippers;

second grippers for taking over the leading gripper margin of the respective sheet from said first grippers, said second grippers revolving in a second direction opposite to said first direction;

at least one pair of sheet supports rotating about a rotational axis and formed with a pitch surface disposed concentric with said rotational axis, said pitch surface having an extent along said rotational axis less than the width of a respective nonprinted lateral margin of the respective sheet, and serving to press the sheet against said support surface within a respective lateral margin; and suction grippers;

said sheet supports and said suction grippers jointly rotating in said second direction about said rotational axis;

said suction grippers being adapted for taking over from said cylinder a trailing gripper margin of the sheet being pressed against said support surface of said cylinder by said sheet supports;

said sheet supports, while pressing the sheet against said support surface, being in successive rolling contact with the sheet from the leading margin unto the trailing margin of the sheet.

2. The transport device according to claim 1, further comprising a sheet guiding drum including said second grippers, said sheet supports and said suction grippers.

3. The transport device according to claim 2, further comprising:

a transfer drum connected in series with said sheet guiding drum and operationally rotating in said first direction, said transfer drum having third grippers for taking over the leading gripper margin from said second grippers, and having suckers following said third grippers for taking over the trailing gripper margin from said suction grippers; and an operationally revolving continuous conveyor including pregrippers and post-grippers, said pregrippers for taking over the leading gripper margin from said third grippers, and said post-grippers for taking over the trailing gripper margin from said suckers.

4. The transport device according to claim 3, wherein said suckers have an adjustable phase position.

5. The transport device according to claim 1, including an operationally revolving continuous conveyor comprising said second grippers, for taking over the leading gripper margin of the respective sheet from said first grippers, and trailing edge grippers for taking over the trailing gripper margin of the respective sheet from said suction grippers.

6. The transport device according to claim 5, wherein said trailing edge grippers grasp the trailing gripper margin in an outlet wedge of a nip formed between said support surface and said pitch surfaces.

7. The transport device according to claim 1, wherein said sheet supports have an adjustable mutual spacing.

8. The transport device according to claim 1, wherein said pitch surfaces have an adjustable circumferential extent.

9. The transport device according to claim 1, wherein said suction grippers have an adjustable phase position.

10. A sheet-processing machine including a device for transporting a sheet in a processing direction, the sheet-transporting device comprising:

first grippers for gripping the sheet at a leading gripper viewed in the direction of processing, said first grippers revolving in a first direction during operation;

a cylinder bearing said first grippers, said cylinder having a support surface formed at the circumference thereof for supporting the sheet gripped by said first grippers;

second grippers for taking over the leading gripper margin of the respective sheet from said first grippers, said second grippers revolving in a second direction opposite to said first direction;

at least one pair of sheet supports rotating about a rotational axis and formed with a pitch surface disposed concentric with said rotational axis, said pitch surface having an extent along said rotational axis less than the width of a respective nonprinted lateral margin of the respective sheet, and serving to press the sheet against said support surface within a respective lateral margin; and suction grippers;

said sheet supports and said suction grippers jointly rotating in said second direction about said rotational axis;

said suction grippers being adapted for taking over from said cylinder a trailing gripper margin of the sheet being pressed against said support surface of said cylinder by said sheet supports;

said sheet supports, while pressing the sheet against said support surface, being in successive rolling contact with the sheet from the leading margin unto the trailing margin of the sheet.

11. A rotary printing machine including a device for transporting a sheet in a processing direction, the sheet-transporting device comprising:

first grippers for gripping the sheet at a leading gripper margin, as viewed in the direction of processing, said first grippers revolving in a first direction during operation;

a cylinder bearing said first grippers, said cylinder having a support surface formed at the circumference thereof for supporting the sheet gripped by said first grippers;

second grippers for taking over the leading gripper margin of the respective sheet from said first grippers, said second grippers revolving in a second direction opposite to said first direction;

at least one pair of sheet supports rotating about a rotational axis and formed with a pitch surface disposed concentric with said rotational axis, said pitch surface having an extent along said rotational axis less than the width of a respective nonprinted lateral margin of the respective sheet, and serving to press the sheet against said support surface within a respective lateral margin; and suction grippers;

said sheet supports and said suction grippers jointly rotating in said second direction about said rotational axis;

said suction grippers being adapted for taking over from said cylinder a trailing gripper margin of the sheet being pressed against said support surface of said cylinder by said sheet supports;

said sheet supports, while pressing the sheet against said support surface, being in successive rolling contact with the sheet from the leading margin unto the trailing margin of the sheet.

* * * * *

UNITED STATES PATENT AND TRADEMARK OFFICE

CERTIFICATE OF CORRECTION

PATENT NO. : 6,578,846 B2
DATED : July 6, 2004
INVENTOR(S) : Goble et al.

It is certified that error appears in the above-identified patent and that said Letters Patent is hereby corrected as shown below:

Column 15,
Line 59, change “at least one” to -- both --.

Column 17,
Line 41, change “at least one” to -- both --.

Column 18,
Line 51, before “return”, insert -- active and --, and change “electrode” to -- electrodes --.
Line 60, change “at least the second conductor is” to -- the first and second conductors are --.

Column 19,
Line 10, change “said return zone” to -- both zones --.

Column 20,
Line 3, change “said return zone” to -- both zones --.

Signed and Sealed this

Twenty-sixth Day of July, 2005

JON W. DUDAS
*Director of the United States Patent and Trademark Office*

UNITED STATES PATENT AND TRADEMARK OFFICE

CERTIFICATE OF CORRECTION

PATENT NO. : 6,578,846 B2
DATED : July 6, 2004
INVENTOR(S) : Goble et al.

It is certified that error appears in the above-identified patent and that said Letters Patent is hereby corrected as shown below:

This certificate supersedes Certificate of Correction issued July 26, 2005, the number was erroneously mentioned and should be vacated since no Certificate of Correction was granted.

Signed and Sealed this

Sixteenth Day of August, 2005

JON W. DUDAS
*Director of the United States Patent and Trademark Office*